United States Patent [19]

Bayly

[11] 4,406,917

[45] Sep. 27, 1983

[54] INSULATOR FOR ELECTRICAL HEATING ELEMENT ASSEMBLY

[75] Inventor: William I. Bayly, Livingston, N.J.

[73] Assignee: AGF Inc., Elizabeth, N.J.

[21] Appl. No.: 310,032

[22] Filed: Oct. 9, 1981

Related U.S. Application Data

[62] Division of Ser. No. 144,238, Apr. 28, 1980, Pat. No. 4,322,606.

[51] Int. Cl.[3] ..... H01B 17/00

[52] U.S. Cl. ..... 174/138 J; 174/156

[58] Field of Search ..... 174/138 J, 155, 156, 174/146; 219/550; 338/321

[56] References Cited

U.S. PATENT DOCUMENTS

| | | | |
|---|---|---|---|
| 308,954 | 12/1884 | Draper | 174/156 |
| 3,027,419 | 3/1962 | Owen et al. | 174/146 X |
| 3,441,712 | 4/1969 | Hynes | 174/155 X |

*Primary Examiner*—Laramie E. Askin

*Attorney, Agent, or Firm*—Lerner, David, Littenberg, Krumholz & Mentlik

[57] ABSTRACT

An insulator for an electrical heating element includes an inner section and an outer section removably disposed thereabout. The electrical heating element is removably and loosely received within at least one of the sections. Several of these insulators can be used to make a new and improved electrical heating element assembly.

4 Claims, 3 Drawing Figures

INSULATOR FOR ELECTRICAL HEATING ELEMENT ASSEMBLY

This is a division of application Ser. No. 144,238, filed Apr. 28, 1980, now U.S. Pat. No. 4,322,606.

FIELD OF THE INVENTION

The present invention relates to electrical insulators and electrical heating element assemblies, and, more particularly, to such insulators and heating element assemblies which are especially useful in radiant tube heating apparatus.

BACKGROUND OF THE INVENTION

Multisectional insulators for electrical heaters have been known for many years. For instance, Hynes U.S. Pat. No. 2,790,889 discloses a fluid electric heater including a cluster of resistor ribbons which are supported by a plurality of spaced-apart, gear-like insulators. Each of the gear-like insulators cooperates with a corresponding group of insulator clips to clamp a portion of each of the resistor ribbons therebetween. Each of the clips has a recess in its outer edge for receiving a band extending around all of the clips of a corresponding group to hold them in place. The gear-like insulators are supported by a central rod or tube. The electric heater is contained in a tubular housing, which may be disposed vertically or horizontally. The clips function to prevent the resistor ribbons, which act as heating elements when energized, from contacting the housing, through which a fluid to be heated passes.

Because the resistor ribbons are gripped and supported by the gear-like insulators and the insulator clips, the natural expansion and contraction of the resistor ribbons are inhibited. Inhibiting such expansion and contraction can result in the breakage of the resistor ribbons. Also, inasmuch as the gear-like insulators and the insulator clips do not completely insulate each resistor ribbon from its adjacent resistor ribbons, the electric heater of the Hynes '889 patent suffers from the further disadvantage that its operation could be deleteriously affected by adjacent resistor ribbons coming into contact with each other, for instance, if they are heated to a temperature sufficiently high to cause them to become soft and deformable. If the resistor ribbons come into contact with each other, shorting and resistor ribbon failure could result.

Hynes U.S. Pat. Nos. 2,963,539 and 3,441,712 disclose electrical resistor heaters employing insulators which are somewhat similar to the insulators described and illustrated in the Hynes '889 patent. Like the insulators of the Hynes '889 patent, the insulators of the Hynes '539 and '712 patents grip and support resistors passing therethrough and, therefore, suffer from at least one of the above-described problems of the electric heater disclosed in the Hynes '889 patent.

SUMMARY OF THE INVENTION

The problems and disadvantages of the prior art insulators described above are overcome by the present invention in which an electrical insulator includes an inner section and an outer section removably disposed thereabout. At least one of the sections is slotted or otherwise formed so as to receive a plurality of heating elements or various legs of a single heating element. The inner and outer sections cooperate to completely surround each heating element or heating element leg, so that the heating elements or heating element legs are electrically insulated from each other. The slots are sized and shaped so that each heating element or heating element leg is loosely and movably received in a corresponding slot, thereby permitting unrestrained expansion and contraction of the heating elements or the heating element legs. Because the outer section is removable, the heating element or elements may be removed from the insulator without destroying the insulator.

The insulator of the present invention is especially useful in an electrical heating element assembly for use in a radiant tube heating apparatus. In one embodiment, the electrical heating element assembly includes a plurality of the insulators, each of which includes a slotted disc manufactured, for example, from ceramic and functioning as the inner section of the insulator. The slotted discs are spaced along the length of the electrical heating element assembly and separated by ceramic spacers. The slotted discs, each of which has a plurality of slots in an outer peripheral edge thereof, have a diameter which is greater than the diameter of the spacers, so that a heating element, such as a heavy gauge metal alloy strip bent into a serpentine pattern, can be inserted into the slots. The ceramic material between each adjacent pair of slots insulates adjacent legs of the heating element from each other.

The peripheral edge of each of the slotted discs is surrounded by a removable retaining ring, which functions as the outer section of the insulator and electrically insulates the heating element from a radiant tube containing the electrical heating element assembly. The retaining ring is held in abutment with the peripheral edge of a corresponding slotted disc by an alloy wire wrapped around the outer circumferential edge of the retaining ring and by several wire loops extending generally radially outwardly from the slotted disc, each loop being sized and shaped such that the retaining ring passes therethrough in close proximity thereto. Axial displacement of each slotted disc relative to a corresponding retaining ring is inhibited by providing a tongue and groove joint therebetween. Because the retaining ring is removable, the electrical heating element assembly can be disassembled for repair or maintenance purposes without destroying the retaining rings or the slotted discs.

A support rod extends from one end of the electrical heating element assembly to the other end thereof and passes through each of the spacers and slotted discs. The support rod retains each of the slotted discs between a pair of adjacent spacers to strengthen the heating element assembly and prevent bending thereof, especially in vertical installations. The support rod also facilitates removal of the electrical heating element assembly from the radiant tube, regardless of whether the electrical heating element assembly is in a hot or cold state.

BRIEF DESCRIPTION OF THE DRAWINGS

For a more complete understanding of the present invention, reference may be had to the following description of an exemplary embodiment taken in conjunction with the accompanying figures of the drawings, in which.

DESCRIPTION OF AN EXEMPLARY EMBODIMENT

While the present invention is applicable to any type of heating apparatus, it is especially suitable for use in connection with a radiant tube heating apparatus. Thus, the present invention will be described with particular reference to a radiant tube heating apparatus.

Figure 1:
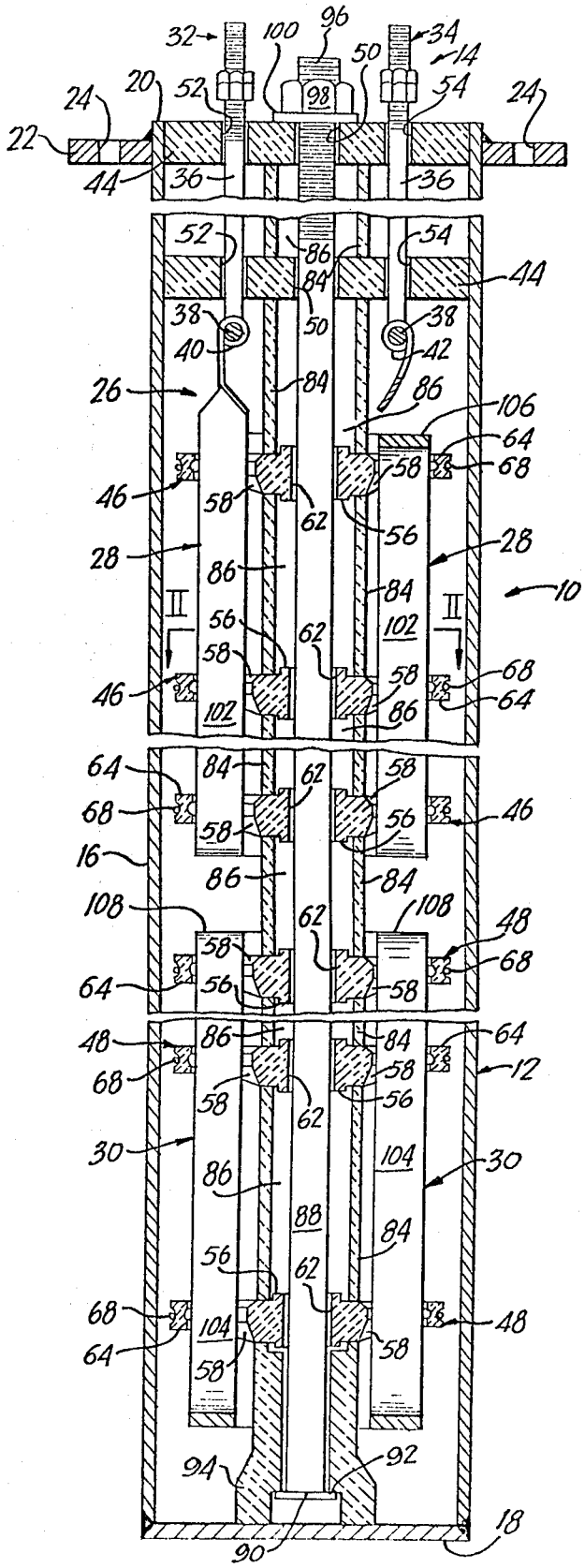
FIG. 1 is a cross-sectional view of a radiant tube heating apparatus employing insulators and an electrical heating element assembly constructed in accordance with the present invention, the cross-sectional view being taken through a plane containing a longitudinal axis of the radiant tube heating apparatus.
Figure 2:
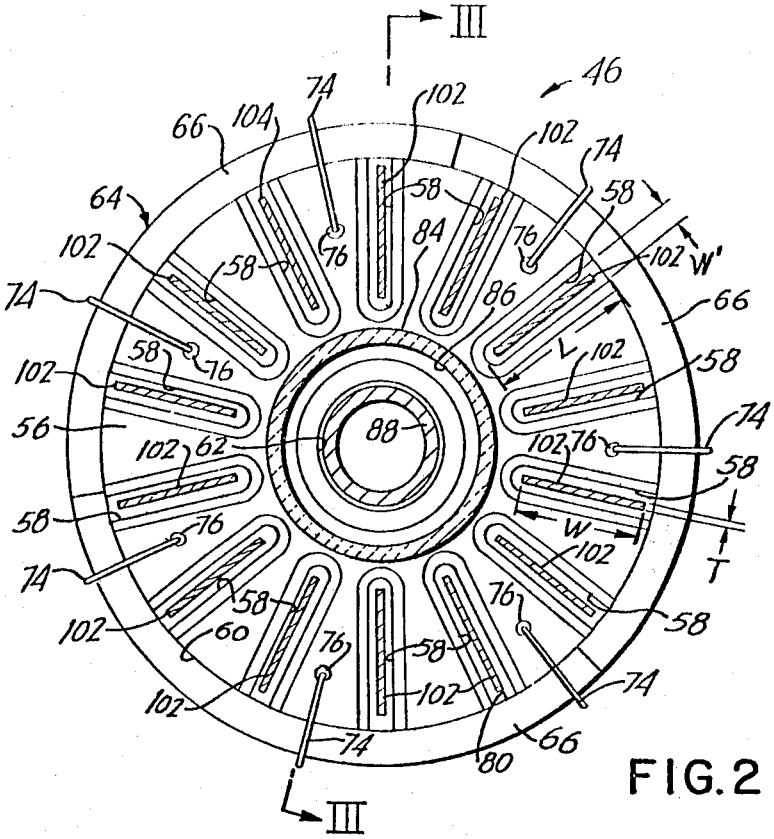
FIG. 2 is a cross-sectional view, taken along the line II—II in FIG. 1 and looking in the direction of the arrows, of the heating apparatus shown in FIG. 1.
Figure 3:
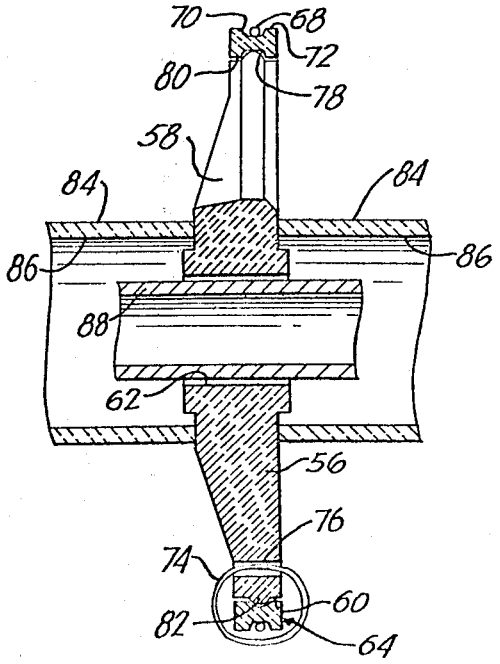
FIG. 3 is a cross-sectional view, taken along line III—III in FIG. 2 and looking in the direction of the arrows, of the insulator illustrated in FIG. 2.

Referring to FIGS. 1-3, there is shown a radiant tube heating apparatus 10 including a radiant tube 12 and a heating element assembly 14 housed within the radiant tube 12. The radiant tube 12, which can be made from any suitable metallic material, such as a casting alloy, includes a hollow cylindrical body 16 closed at its lower end 18 and open at its upper end 20. A flange 22, which extends radially outwardly from the radiant tube 12, is attached by, for instance, welding to the radiant tube 12 substantially adjacent the open upper end 20 thereof. The flange 22, which seals a furnace chamber (not shown) from the heating apparatus 10, has a plurality of openings 24 therein for mounting the heating apparatus 10 from a suitable support structure (not shown).

The heating element assembly 14 includes a heating element 26 made, for example, from heavy gauge alloy heating strips 28, 30, each of which is bent into a serpentine pattern and connected in series to the other heating strip. The heating strips 28, 30 are electrically connected to a source of electrical energy (not shown) by a pair of terminal posts 32, 34, respectively, located at the open upper end 20 of the radiant tube 12. Each of the terminal posts 32, 34 is generally L-shaped and has a long leg 36 extending generally parallel to the longitudinal axis of the radiant tube 12 and a short leg 38 forming a 90° angle with the long leg 36. The heating strips 28, 30 have free ends 40, 42, respectively, each of which is wrapped about a corresponding one of the short legs 38 of the terminal posts 32, 34.

The heating element assembly 14 also includes a first set of insulators 44, a second set of insulators 46, and a third set of insulators 48. The insulators 44 are fixedly positioned within the radiant tube 12 adjacent the open upper end 20 thereof. Each of the insulators 44 has a central bore 50 and a pair of openings 52, 54 located radially outwardly with respect to the bore 50. The terminal posts 32, 34 extend through the openings 52, 54, respectively.

With particular reference to FIGS. 2 and 3, each of the insulators 46, 48 includes a slotted disc 56 made from ceramic or some other suitable electrical-insulating and heat-resistant material and having slots 58 formed in an outer peripheral edge 60 thereof and a centrally located bore 62. The outer peripheral edge 60 of each of the slotted discs 56 is surrounded by a corresponding retaining ring 64, including three arcuate segments 66. Each of the retaining rings 64 is held in removable engagement with the outer peripheral edge 60 of a corresponding one of the slotted discs 56 by an alloy wire 68, which seats in an annular groove 70 formed in an outer circumferential edge 72 of the retaining ring 64, and wire loops 74 through which the retaining ring 64 passes. Each of the loops 74 is attached to the slotted disc 56 by passing the loop through one of a plurality of openings 76 extending axially through the slotted disc 56. Axial movement of each of the retaining rings 64 relative to a corresponding one of the slotted discs 56 is inhibited by forming an annular groove 78 in an inner peripheral edge 80 of each of the retaining rings 64 and providing the outer peripheral edge 60 of each of the slotted discs 56 with a tongue 82 which mates with the groove 78 in a corresponding one of the retaining rings 64.

Each of the insulators 44, 46, 48 is separated from an adjacent one of the insulators 44, 46, 48 by a corresponding one of a plurality of axially aligned ceramic spacers 84, each of the spacers 84 being provided with a central bore 86. The bores 86 in the spacers 84 are aligned axially with the bores 62 formed in the slotted discs 56 and the bores 50 formed in the insulators 44. The bores 50, 62, 86 receive a support rod 88, which extends from the closed lower end 18 of the radiant tube 12 to the open upper end 20 thereof. A washer 90, fixedly attached to the lower end of the support rod 88, engages an internal shoulder 92 provided in a ceramic support 94 interposed between the closed lower end 18 of the radiant tube 12 and the lowermost one of the insulators 48. The upper end of the support rod 88 has external threads 96 adapted to threadedly engage a nut 98, which presses a washer 100 against the uppermost one of the insulators 44, thereby retaining each of the slotted discs 56 between an adjacent pair of the spacers 84. The support rod 88 strengthens the heating element assembly 14, thereby preventing its bending, especially in vertical installations, and facilitates removal of the heating element assembly 14 from the radiant tube 12 or, if the radiant tube 12 is not utilized, from a furnace, regardless of whether the heating element assembly 14 is in a hot or cold state.

The insulators 46, 48 are arranged one above the other in such a manner that the slots 58 in each one of the slotted discs 56 are aligned axially with the slots 58 in the other slotted discs 56 so as to form a plurality of guideways aligned axially along the length of the radiant tube 12. The heating strip 28 extends downwardly from the terminal post 32 through one of fourteen guideways formed by the slotted discs 56 of the insulators 46 and then is wound up and down in a clockwise direction through twelve of the succeeding guideways formed by the slotted discs 56 of the insulators 46. The heating strip 28 terminates after passing down the thirteenth of the fourteen guideways to a point below the lowermost one of the insulators 46. At this point, the heating strip 28 is connected, for instance, by welding to the heating strip 30, which passes down through one of the fourteen guideways formed by the slotted disc 56 of the insulators 48. The heating strip 30 is then wound up and down in a counterclockwise direction through the thirteen succeeding guideways formed by the slotted discs 56 of the insulators 48. After passing upwardly through the fourteenth or last guideway, the heating strip 30 continues upward and passes through the fourteenth or last guideway formed by the slotted discs 56 of the insulators 46. Once beyond the uppermost one of the insulators 46, the heating strip 30 is attached to the terminal post 34. Thus, the guideways formed by the slotted discs 56 of the insulators 46 receive successive legs 102 of the heating strip 28 and one of a plurality of legs 104 of the heating strip 30. All of the legs 104 of the heating strip 30 extend through the guideways formed by the discs 56 of the insulators 48.

Turns 106, formed in the heating strip 28 when winding it through the guideways formed by the slotted discs 56 of the insulators 46, engage the uppermost one of the insulators 46. Similarly, in order to wind the heating strip 30 through the guideways formed by the slotted discs 56 of the insulators 48, turns 108 are formed in the heating strip 30. The turns 108 engage the uppermost one of the insulators 48. Thus, the heating element 26 is supported by the insulators 46, 48, as well as the terminal posts 32, 34.

The ceramic material between the slots 58 of the slotted discs 56 of the insulators 46 electrically insulates the legs 102 of the heating strip 28 from each other and one of the legs 104 of the heating strip 30. Similarly, the legs 104 of the heating strip 30 are electrically insulated from each other by the ceramic material between the slots 58 of the slotted discs 56 of the insulators 48. The spacing between the insulators 46, 48 is selected such that the legs 102, 104 of the heating strips 28, 30, respectively, will not contact each other between the insulators 46, 48, even if the heating strips 28, 30 are heated to a temperature sufficiently high to make them soft and deformable, thereby preventing shorting and possible failure of the heating element 26. The retaining rings 64 electrically insulate the heating strips 28, 30 from the radiant tube 12.

The heating strips 28, 30 have a width W and thickness T. The slots 58 formed in the slotted discs 56 have a length L and a width W'. The thickness T and width W of the heating strips 28, 30 are less than the width W' and length L of the slots 58, respectively, so that the legs 102, 104 of the heating strips 28, 30, respectively, are loosely and movably received within the slots 58, thereby permitting the unrestrained expansion and contraction of the heating element 26.

In order to remove and repair or replace one of the heating strips 28, 30 or a portion thereof, the wires 68 and loops 74 are severed and the retaining rings 64 are removed from about the discs 56, thereby providing access to the slots 58 formed therein and allowing removal of the heating strips 28, 30 from the slots 58. After repair of replacement, the heating strips 28, 30 are returned to the slots 58. The retaining rings 64 are then replaced and fixedly secured in place by replacing the wires 68 and the loops 74.

It will be understoosd that the embodiment described herein is merely exemplary and that a person skilled in the art may make many variations and modifications without departing from the spirit and scope of the invention. For instance, the heating apparatus 10 can be used in horizontal installations, as well as in vertical installations. Also, the slots 58 could be formed in the retaining rings 64, rather than in the slotted discs 56 or in the retaining rings 64 and the slotted discs 56. Furthermore, it is possible to construct the heating element 26 from a single heating strip. All such modifications and variations are intended to be included within the scope of the invention as defined in the appended claims.

What is claimed is:

1. An electrical insulator for use in an electrical heating element assembly which includes a plurality of heating means, said insulator comprising an inner section having an outer peripheral edge; an outer section in the form of a retaining ring having an inner peripheral edge, an outer circumferential edge and an annular recess formed in said outer circumferential edge; positioning means for removably positioning said outer section about said inner section such that said outer peripheral edge of said inner section is substantially adjacent said inner peripheral edge of said retaining ring, said positioning means including a piece of wire wrapped around said outer circumferential edge of said retaining ring and seated in said annular recess therein and a plurality of wire loops, each loop extending generally radially outwardly from said inner section and being sized and shaped such that said retaining ring passes therethrough in close proximity thereto; and receiving means provided in one of said peripheral edges for removably receiving a plurality of electrical heating means, said inner and outer sections cooperating to completely surround each heating means, whereby each heating means may be electrically insulated from the other heating means, and said receiving means being sized and shaped such that each heating means may be loosely and movably received between the surrounding surfaces of said inner and outer sections, whereby the natural expansion of a plurality of heating means insulated by said insulator is not inhibited during the electrical energization thereof for heating purposes.

2. An electrical insulator according to claim 1, wherein said retaining ring is made from a plurality of arcuate segments arranged end to end.

3. An electrical insulator for use in an electrical heating element assembly which includes a plurality of heating means, said insulator comprising an inner section having an outer peripheral edge, an outer section having an inner peripheral edge, positioning means for removably positioning said outer section about said inner section such that said outer peripheral edge of said inner section is substantially adjacent said inner peripheral edge of said outer section, fixing means for fixing the axial position of said outer section relative to said inner section, said fixing means including a tongue and groove joint which includes a tongue provided on one of said peripheral edges and a groove provided in the other of said peripheral edges, and receiving means provided in one of said peripheral edges for removably receiving a plurality of electrical heating means, said inner and outer sections cooperating to completely surround each heating means, whereby each heating means may be electrically insulated from the other heating means, and said receiving means being sized and shaped such that each heating means may be loosely and movably received between the surrounding surfaces of said inner and outer sections, whereby the natural expansion of a plurality of heating means insulated by said insulator is not inhibited during the electrical energization thereof for heating purposes.

4. An improved electrical insulator according to claim 3, wherein said tongue is provided on said outer peripheral edge of said inner section and said groove is formed in said inner peripheral edge of said outer section.

* * * * *